US011680708B2

(12) United States Patent
Seok

(10) Patent No.: US 11,680,708 B2
(45) Date of Patent: Jun. 20, 2023

(54) MULTI-TUBE COMBUSTOR AND GAS TURBINE INCLUDING SAME

(71) Applicant: DOOSAN ENERBILITY CO., LTD, Changwon (KR)

(72) Inventor: Jung Min Seok, Gimhae (KR)

(73) Assignee: DOOSAN ENERBILITY CO., LTD., Changwon (KR)

( * ) Notice: Subject to any disclaimer, the term of this patent is extended or adjusted under 35 U.S.C. 154(b) by 0 days.

(21) Appl. No.: 17/540,242

(22) Filed: Dec. 2, 2021

(65) Prior Publication Data

US 2022/0228745 A1 Jul. 21, 2022

(30) Foreign Application Priority Data

Jan. 15, 2021 (KR) ..... 10-2021-0006133

(51) Int. Cl.
*F23R 3/04* (2006.01)
*F23R 3/28* (2006.01)
(Continued)

(52) U.S. Cl.
CPC ..... *F23R 3/045* (2013.01); *F23R 3/26* (2013.01); *F23R 3/286* (2013.01); *F23R 3/34* (2013.01)

(58) Field of Classification Search
CPC ..... F23R 3/045; F23R 3/286; F23R 2900/00014; F23R 3/34; F23R 3/343;
(Continued)

(56) References Cited

U.S. PATENT DOCUMENTS 5,209,187 A * 5/1993 Khinkis ..... F23D 14/82 431/9
2012/0180487 A1* 7/2012 Uhm ..... F23R 3/286 60/737

(Continued)

FOREIGN PATENT DOCUMENTS

JP 2015-096794 A 5/2015
KR 10-2146564 B1 8/2020
KR 10-2164622 B1 10/2020

OTHER PUBLICATIONS

Mogas, Tech Talk—Purging for Delayed Coking, Dec. 10, 2018 (Year: 2018).*

*Primary Examiner* — Stephanie Sebasco Cheng
*Assistant Examiner* — Jingchen Liu
(74) *Attorney, Agent, or Firm* — Harvest IP Law LLP

(57) ABSTRACT

A multi-tube combustor is provided. The multi-tube combustor includes a plurality of fuel nozzles disposed in a nozzle tube provided inside a nozzle casing, each fuel nozzle having a cavity, a plurality of compressed air supply tubes connected to the plurality of fuel nozzles and configured to supply a compressed air to the plurality of fuel nozzles, and an on/off valve provided on the plurality of compressed air supply tubes to open and close the compressed air supply tubes. The fuel and the compressed air are mixed inside the plurality of fuel nozzles, and the plurality of fuel nozzles are divided into a plurality of fuel nozzle groups, and a mixture of the fuel and the compressed air is ejected from one or more selected fuel nozzle groups of the plurality of fuel nozzle groups according to a combustion load condition or during a ramp-up process.

13 Claims, 5 Drawing Sheets

(51) Int. Cl.
*F23R 3/26* (2006.01)
*F23R 3/34* (2006.01)

(58) Field of Classification Search
CPC ..... F23R 3/346; F05D 2260/96; F05D 2260/963–964; F05D 2260/205; F23D 14/62; F23D 14/64; F02C 7/18
See application file for complete search history.

(56) References Cited

U.S. PATENT DOCUMENTS

| | | | | |
|---|---|---|---|---|
| 2013/0122437 | A1* | 5/2013 | Melton | F23R 3/286 431/12 |
| 2016/0230999 | A1* | 8/2016 | Okazaki | F23D 11/102 |
| 2019/0056112 | A1* | 2/2019 | Natarajan | F23R 3/46 |
| 2019/0360697 | A1* | 11/2019 | Tada | F23D 14/62 |

* cited by examiner

MULTI-TUBE COMBUSTOR AND GAS TURBINE INCLUDING SAME

CROSS REFERENCE TO RELATED APPLICATION

This application claims priority to Korean Patent Application No. 10-2021-0006133, filed on Jan. 15, 2021, the disclosure of which is incorporated herein by reference in its entirety.

BACKGROUND

1. Field

Apparatuses and methods consistent with exemplary embodiments relate to a multi-tube combustor and a gas turbine including the same, and more particularly, to a multi-tube combustor for mixing compressed air supplied from a compressor with fuel, combusting the mixture, and supplying the combustion gas to a turbine.

2. Description of the Related Art

A turbine refers to a driving force generating device that converts thermal energy of a fluid such as gas or steam into mechanical energy such as rotary force. The turbine includes a rotor having a plurality of buckets axially rotated by a fluid and a casing installed to surround the rotor and provided with a plurality of diaphragms.

A gas turbine includes a compressor section, a combustor, and a turbine section. The compressor section intakes external air, compresses the air, and transfers the compressed air to the combustor. The combustor mixes the compressed air compressed by the compressor section and fuel are mixed to produce combustion gas. The high-temperature and high-pressure combustion gas generated from the combustor rotates the rotor of the turbine section to drive a generator.

The combustor injects fuel to the compressed air to mix the fuel with the compressed air and combusts the fuel-air mixture in the combustion chamber. When supplying the fuel-air mixture to the combustion chamber, it is important to increase the mixing uniformity of the fuel-air mixture. If the mixing uniformity of the fuel-air mixture is improved, the vibration of the combustor during combustion is reduced, thereby improving the overall power generation efficiency of the gas turbine.

However, when the fuel-air mixture is combusted in the combustor chamber and a flame is uniformly induced, there is a problem in that vibration occurs during the ramp-up process after ignition.

SUMMARY

Aspects of one or more exemplary embodiments provide a multi-tube combustor and a gas turbine having the same.

Additional aspects will be set forth in part in the description which follows and, in part, will become apparent from the description, or may be learned by practice of the exemplary embodiments.

According to an aspect of an exemplary embodiment, there is provided a multi-tube combustor including: a nozzle casing configured to receive compressed air from a compressor section and to receive fuel from outside; a liner coupled to the nozzle casing and defining a combustion chamber in which a mixture of fuel ejected from the nozzle casing and the compressed air is combusted; a transition piece connected to the liner and configured to supply the combustion gas generated in the combustion chamber defined by the liner to a turbine section; a plurality of fuel nozzles disposed in a nozzle tube provided inside the nozzle casing, each fuel nozzle having a cavity; a plurality of compressed air supply tubes connected to the plurality of fuel nozzles and configured to supply the compressed air to the plurality of fuel nozzles; a center body having a first end connected to a nozzle base of the nozzle casing, extended to enter the cavity of the fuel nozzle, and having a second end having a fuel ejection hole through which the fuel is ejected; and an on/off valve provided on the plurality of compressed air supply tubes to open and close the compressed air supply tubes. The fuel and the compressed air are mixed inside the plurality of fuel nozzles, and the plurality of fuel nozzles are divided into a plurality of fuel nozzle groups, and a mixture of the fuel and the compressed air is ejected from one or more selected fuel nozzle groups of the plurality of fuel nozzle groups according to a combustion load condition or during a ramp-up process.

The plurality of fuel nozzle groups may have an overall annular form and may be arranged concentrically.

The plurality of fuel nozzle groups may include: a first fuel nozzle group having a circular form and disposed at a center of the nozzle tube; a second fuel nozzle group disposed in a periphery area of the nozzle tube; and a third fuel nozzle group disposed between the first fuel nozzle group and the second fuel nozzle group.

The third fuel nozzle group may include: one or more first sub-third fuel nozzle groups having an inner circumference adjacent to the first fuel nozzle group and spaced from each other; and one or more second sub-third fuel nozzle groups having an outer circumference adjacent to the second fuel nozzle group and alternately arranged with the one or more first sub-third fuel nozzle groups.

The fuel nozzles of the first fuel nozzle group and the fuel nozzles of the third fuel nozzle group may have different lengths.

The fuel nozzles of the first sub-third fuel nozzle group and the fuel nozzles of the second sub-third fuel nozzle group may have different length The fuel nozzles of the first fuel nozzle group and the fuel nozzles of the third fuel nozzle group may have different diameters, and the fuel nozzles of the first sub-third fuel nozzle group and the fuel nozzles of the second sub-third fuel nozzle group may have different diameters.

Each of the plurality of compressed air supply tubes having a multi-tube form may include: a first compressed air supply tube connected to the fuel nozzles of the first fuel nozzle group to supply the compressed air to the fuel nozzles of the first fuel nozzle group; a second compressed air supply tube connected to the fuel nozzles of the second fuel nozzle group to supply the compressed air to the fuel nozzles of the second fuel nozzle group; and a third compressed air supply tube connected to the fuel nozzles of the third fuel nozzle group to supply the compressed air to the fuel nozzles of the third fuel nozzle group.

The fuel nozzles of the second fuel nozzle group and the fuel nozzles of the third fuel nozzle group may be provided with through-holes through which the first compressed air supply tube and the second compressed air supply tube may intersect.

The combustor may further include a controller configured to control operation of the on/off valve configured to open and close the compressed air supply tubes.

According to an aspect of another exemplary embodiment, there is to provided a gas turbine including: a casing;

a compressor section disposed inside the casing and configured to compress air externally introduced to produce compressed air; a combustor disposed inside the casing and configured to mix the air compressed by the compressor section with fuel and combust a mixture of the compressed air and fuel to produce combustion gas; a turbine section disposed inside the casing and rotated by the combustion gas produced by the combustor to generate power; and a diffuser disposed inside the casing and configured to discharge air from the turbine section. The combustor may include: a nozzle casing configured to receive compressed air from the compressor section and to receive fuel from outside; a liner coupled to the nozzle casing and defining a combustion chamber in which the mixture of the fuel ejected from the nozzle casing and the compressed air is combusted; a transition piece connected to the liner and configured to supply the combustion gas generated in the combustion chamber defined by the liner to the turbine section; a plurality of fuel nozzles disposed in a nozzle tube provided inside the nozzle casing, each fuel nozzle having a cavity; a plurality of compressed air supply tubes connected to the plurality of fuel nozzles and configured to supply the compressed air to the plurality of fuel nozzles; a center body having a first end connected to a nozzle base of the nozzle casing, extended to enter the cavity of the fuel nozzle, and having a second end having a fuel ejection hole through which the fuel is ejected; and an on/off valve provided on the plurality of compressed air supply tubes to open and close the compressed air supply tubes. The fuel and the compressed air are mixed inside the plurality of fuel nozzles, and the plurality of fuel nozzles are divided into a plurality of fuel nozzle groups, and a mixture of the fuel and the compressed air is ejected from one or more selected fuel nozzle groups of the plurality of fuel nozzle groups according to a combustion load condition or during a ramp-up process.

In the multi-tube combustor and the gas turbine according to one or more exemplary embodiments, the plurality of fuel nozzles disposed in the nozzle tube are divided into a plurality of fuel nozzle groups, and each fuel nozzle group is arranged in an annular concentric circle in order from the center of the nozzle tube, and the fuel nozzles have different diameters for each fuel nozzle group. Thus, the mixing ratio of the fuel and the compressed air is adjusted according to the selection of the fuel nozzle groups through which the fuel-air mixture is to be ejected to easily meet the required load conditions or to cope with combustion vibrations. Therefore, it is possible to actively cope with fluctuation in NOx level and combustion vibration to stably generate flames, and to reduce vibrations generated during the ramp-up process after starting the gas turbine.

BRIEF DESCRIPTION OF THE DRAWINGS

The above and other aspects will become more apparent from the following description of the exemplary embodiments with reference to the accompanying drawings, in which.

DETAILED DESCRIPTION

Figure 1:
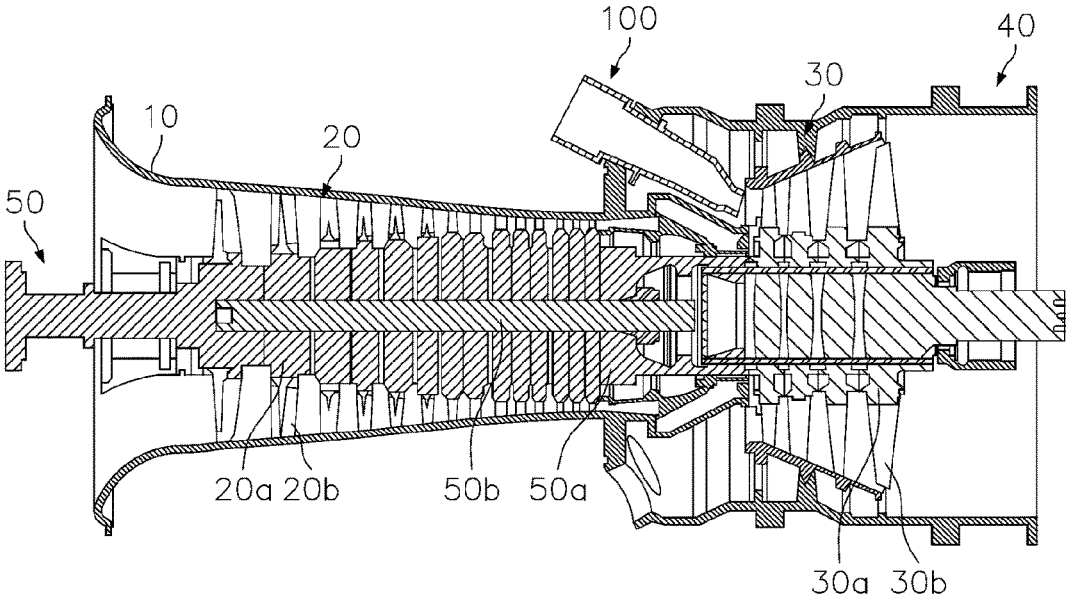
FIG. 1 is a cross-sectional view of a gas turbine according to an exemplary embodiment.

Various modifications and various embodiments will be described with reference to the accompanying drawings. However, it should be noted that the various embodiments are not for limiting the scope of the disclosure to the specific embodiment, but they should be interpreted to include all modifications, equivalents, or substitutions of the embodiments included within the spirit and scope disclosed herein.

Terms used herein are used to merely describe specific embodiments and are not intended to limit the scope of the disclosure. As used herein, an element expressed as a singular form includes a plurality of elements, unless the context clearly indicates otherwise. Further, it will be understood that the term "comprising" or "including" specifies the presence of stated features, numbers, steps, operations, elements, parts, or combinations thereof, but does not preclude the presence or addition of one or more other features, numbers, steps, operations, elements, parts, or combinations thereof.

For clear illustration, components that are irrelevant to the description are omitted, and like reference numerals refer to like components throughout the specification. In certain embodiments, a detailed description of known functions and configurations that may obscure the gist of the present disclosure will be omitted. For the same reason, some of the elements in the drawings are exaggerated, omitted, or schematically illustrated.

Hereinafter, a configuration of a gas turbine according to an exemplary embodiment will be described with reference to the accompanying drawings. FIG. 1 is a cross-sectional view of a gas turbine according to an exemplary embodiment.

Referring to FIG. 1, a gas turbine includes a casing 10 that serves as an outer shell, a compressor section 20 that compresses incoming air at a high pressure, a combustor 100 that mixes the compressed air compressed by the compressor 20 and fuel and combusts a fuel-air mixture to produce combustion gas, a turbine section 30 driven by the combustion gas to generate electric power, a diffuser 40 for discharging exhaust gas, and a rotor 50 that connects the compressor section 20 and the turbine section 30 to transfer rotary force.

An ideal thermodynamic cycle of a gas turbine may ideally comply with the Brayton cycle. The Brayton cycle consists of four thermodynamic processes: isentropic compression (i.e., an adiabatic compression) process, isobaric combustion process, isentropic expansion (i.e., an adiabatic expansion) process and isobaric heat ejection process. That is, in the Brayton cycle, thermal energy may be released by combustion of fuel in an isobaric environment after atmospheric air is sucked and compressed into high pressure air, hot combustion gas may be expanded to be converted into kinetic energy, and exhaust gas with residual energy may be discharged to the outside. As such, the Brayton cycle consists of four thermodynamic processes including compression, heating, expansion, and exhaust.

Thermodynamically, external air introduced into the compressor section 20 corresponding to an upstream side of the gas turbine undergoes an adiabatic compression process. The compressed air flows into the combustor 100, mixes with fuel, and undergoes an isostatic combustion process.

The combustion gas flows into the turbine section 30 corresponding to a downstream side of the gas turbine.

Here, the compressor section 20 is disposed at a front side (i.e., upstream side) of the casing 10, and the turbine section 30 is disposed at a rear side (i.e., downstream side) of the casing 10 in a direction of air flow. A torque tube 50 *a* for transferring torque generated in the turbine section 30 to the compressor section 20 is installed between the compressor section 20 and the turbine section 30.

The compressor section 20 includes a plurality of compressor rotor disks 20 *a*, and the compressor rotor disks 20 *a* are fastened by a tie rod 50 *b* so as not to be separated from each other in an axial direction of the tie rod 50 *b*.

The tie rod 50 *b* is installed to extend through central holes of the compressor rotor disks 20 *a* that are aligned along the axial direction of the tie rod 50 *a*. A flange is mounted to protrude from one surface of each of the compressor rotor disks in the axial direction, and is disposed at a position close to a periphery of a corresponding compressor rotor disk so that the corresponding rotor disk cannot rotate relative to each other.

A plurality of compressor blades 20 *b* are radially coupled to an outer circumferential surface of each of the compressor rotor disks 20 *a*. Each of the compressor blades 20 *b* has a dovetail-shaped root member which is inserted into a corresponding slot formed in the outer circumferential surface of the compressor rotor disk 20 *a*. In this way, the compressor blades are fastened to the compressor rotor disk.

Examples of a coupling method of the root member include: a tangential type in which the root member is inserted into the compressor disk slot in a tangential direction to the outer circumferential surface of the compressor rotor disk and an axial type in which the root member is inserted into the compressor disk slot in an axial direction of the compressor rotor disk. Alternatively, the compressor blades 20*b* may be fastened to the compressor rotor disk 20*a* using coupling tools other than such types, such as keys or bolts.

In addition, a plurality of vanes (also referred to as nozzles) that are reference positions for relative rotation of the compressor blades 20*b* are mounted on an inner circumferential surface of the casing 10 of the compressor section 20 through diaphragms.

The tie rod 50*b* is arranged to extend through the central holes of the plurality of compressor rotor disks 20*a* such that one end thereof is fastened to the compressor rotor disk 20*a* located on a foremost end side of the compressor and the other end is fixed to the torque tube 50*a*.

Because the tie rod 50*b* may be formed in various structures according to a type of gas turbine, the shape of the tie rod 50*b* is not limited to the example illustrated in FIG. 1. For example, a single tie rod 50*b* in which a single tie rod extends through the central holes of the compressor rotor disks, a multi-type in which multiple tie rods are arranged in a circumferential direction, or a complex type in which the single-type and the multi-type are combined may be used.

Also, the compressor may include vanes serving as guide vanes at a downstream position from the diffuser 40 to control the inflow angle of the compressed fluid entering the combustor to be substantially equal to the designed inflow angle. An assembly of the vanes disposed at the downstream from the diffuser 40 is referred to as a deswirler.

The combustor 100 mixes the compressed air with fuel and burns the fuel-air mixture to produce high-temperature and high-pressure combustion gas, thereby raising the temperature of the combustion gas to a heat-resistant temperature at which the components of the combustor 100 and the turbine section 20 can endure through an isobaric combustion process.

A plurality of combustors constituting the combustor 100 are provided in a form of a cell in the casing 10.

The high-temperature and high-pressure combustion gas supplied to the turbine section 30 expands to provide an impulse force to the rotor blades of the turbine section 30 or cause a reaction force. That is, the thermal energy of the combustion gas is converted into mechanical energy.

A portion of the mechanical energy generated by the turbine section 30 is transferred to the compressor section 20 to be used as energy required to compress air, and remaining portion is used to drive a generator to produce electric power.

The turbine section 30 includes a plurality of stators and a plurality of rotors that are alternately arranged. The combustion gas acts on the rotors to transmit rotary energy to the rotors to rotate the output shaft to which the generator is connected.

To this end, the turbine section 30 includes a plurality of turbine rotor disks 30*a*. Each turbine rotor disk 30*a* has the substantially same shape as the compressor rotor disks 20*a*.

Each turbine rotor disk 30*a* includes a flange to which each turbine rotor disk 30*a* is fastened to a neighboring turbine rotor disk 30*a*. In addition, a plurality of turbine blades 30*b* are radially fastened to the turbine rotor disk 30*a*. Each of the turbine blades 30*b* may be fastened to the turbine rotor disk 30*a* in a dovetail fastening manner.

In addition, a plurality of vanes (also referred to as nozzles) that are reference positions for relative rotation of the turbine blades 30*b* are mounted on the inner circumferential surface of the casing 10 of the turbine section 30 through diaphragms.

In the gas turbine, the intake air is compressed in the compressor section 20, is burned in the combustor 100, then injected into to the turbine section 30 to drive the generator to generate electric power, and discharged to the atmosphere by the diffuser 40.

Here, the torque tubes 50*a*, the compressor rotor disks 20*a*, the compressor blades 20*b*, the turbine rotor disks 30*a*, and the tie rods 50*b* are rotary elements and are collectively referred to as rotor 50 or rotating body. On the other hand, the casing 10, the vanes, and the diaphragms may be collectively referred to as a stator, a fixing body, a stationary part, or a stationary member.

Figure 2:
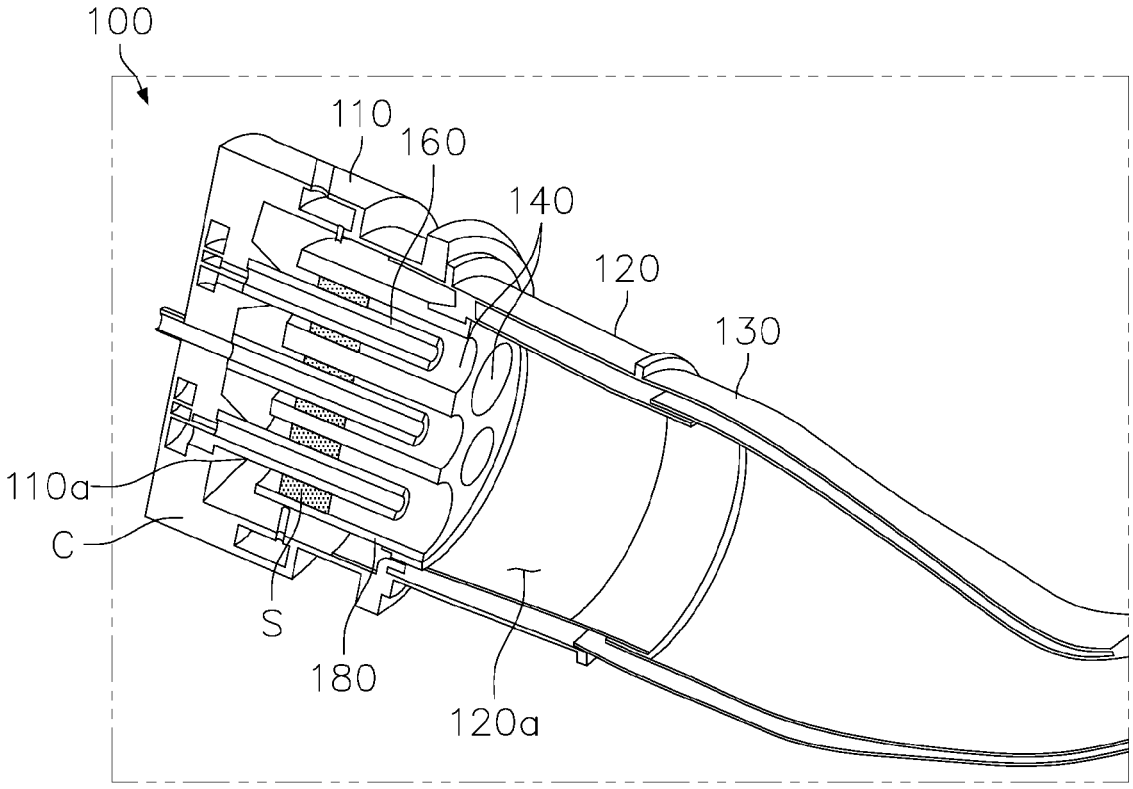
FIG. 2 is a schematic view illustrating an overall construction of a combustor illustrated in FIG. 1.

FIG. 2 is a schematic view illustrating an overall construction of a combustor illustrated in FIG. 1.

Referring to FIGS. 1 and 2, the combustor 100 includes a nozzle casing 110, a liner 120, a transition piece 130, a plurality of fuel nozzles 140, a plurality of compressed air supply tubes 150, a center body, and an on/off valve.

The nozzle casing 110 receives compressed air from the compressor section 20 and receives fuel from the outside. The supplied fuel may be hydrogen but is not limited thereto. The liner 120 is connected to the downstream side of the nozzle casing 110 in the flow direction of compressed air or combustion gas, and a mixture of fuel and compressed air injected from the nozzle casing 110 is burned. The transition piece 130 is connected to the downstream side of the liner 120 to guide the combustion gas generated in the combustion chamber inside the liner 120 to the turbine section 30.

A plurality of fuel nozzles 140 having cavities 140*a* are provided in a nozzle tube 180 included in the nozzle casing 110. The fuel nozzles 140 having a cylinder shape are inserted into openings of the nozzle tube 180 and surrounds the center body 160 extending in the front-and-rear direction of the combustor.

The liner 120 defines a combustion chamber 120*a* in which a mixture of the fuel injected by the plurality of fuel nozzles 140 and the compressed air supplied through the fuel nozzle 140 is burned, and the plurality of fuel nozzles 140 are coupled to the front end of the liner 120.

A first end of the center body 160 is connected to a nozzle base 110*a* of the nozzle casing 110 to receive the fuel from the nozzle base 110*a*, and the fuel is injected through a swirler S or a fuel injection hole formed around the center bodies 160 and mixed with the compressed air. It is understood that the position and shape of the fuel nozzle to which fuel is supplied is not limited to the example shown in FIG. 2 and may have other shapes.

Figure 3:
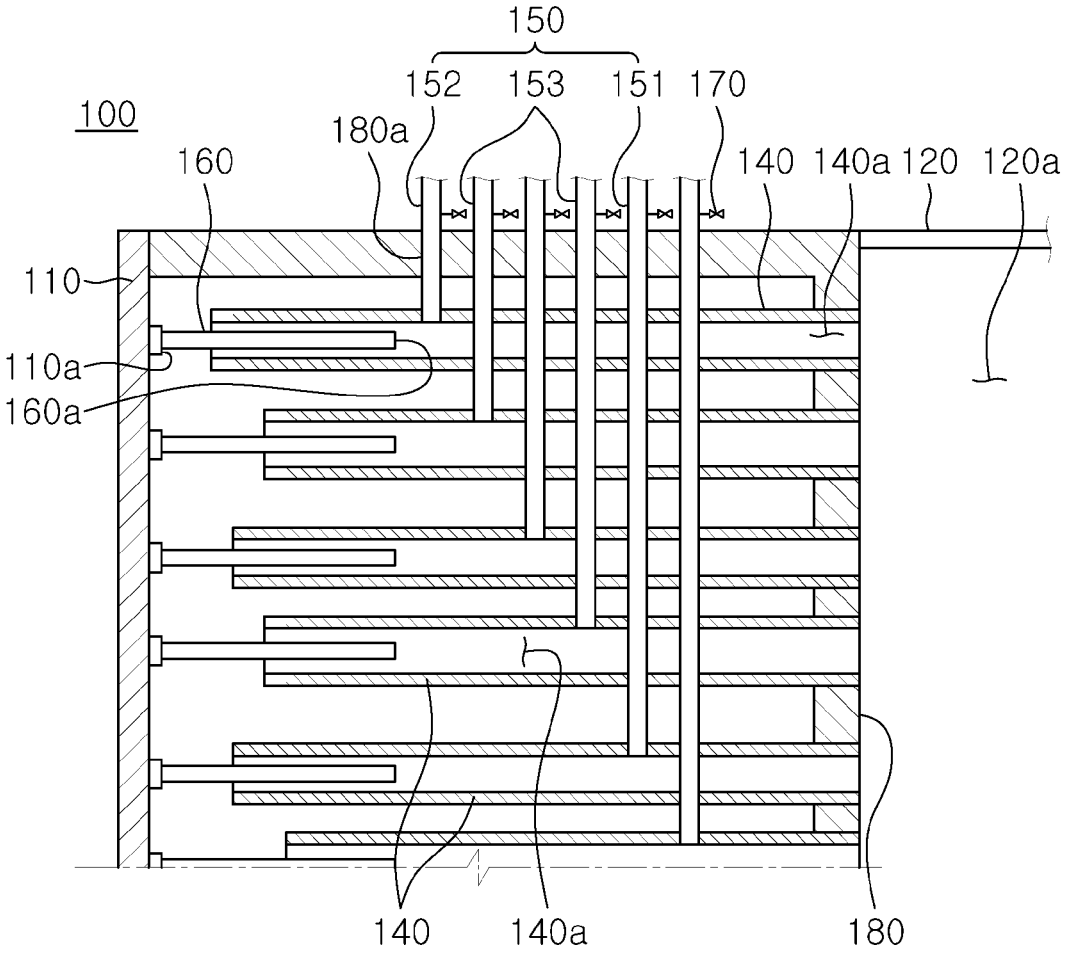
FIG. 3 is a cross-sectional view illustrating a construction of a multi-tube combustor according to another exemplary embodiment.
Figure 4:
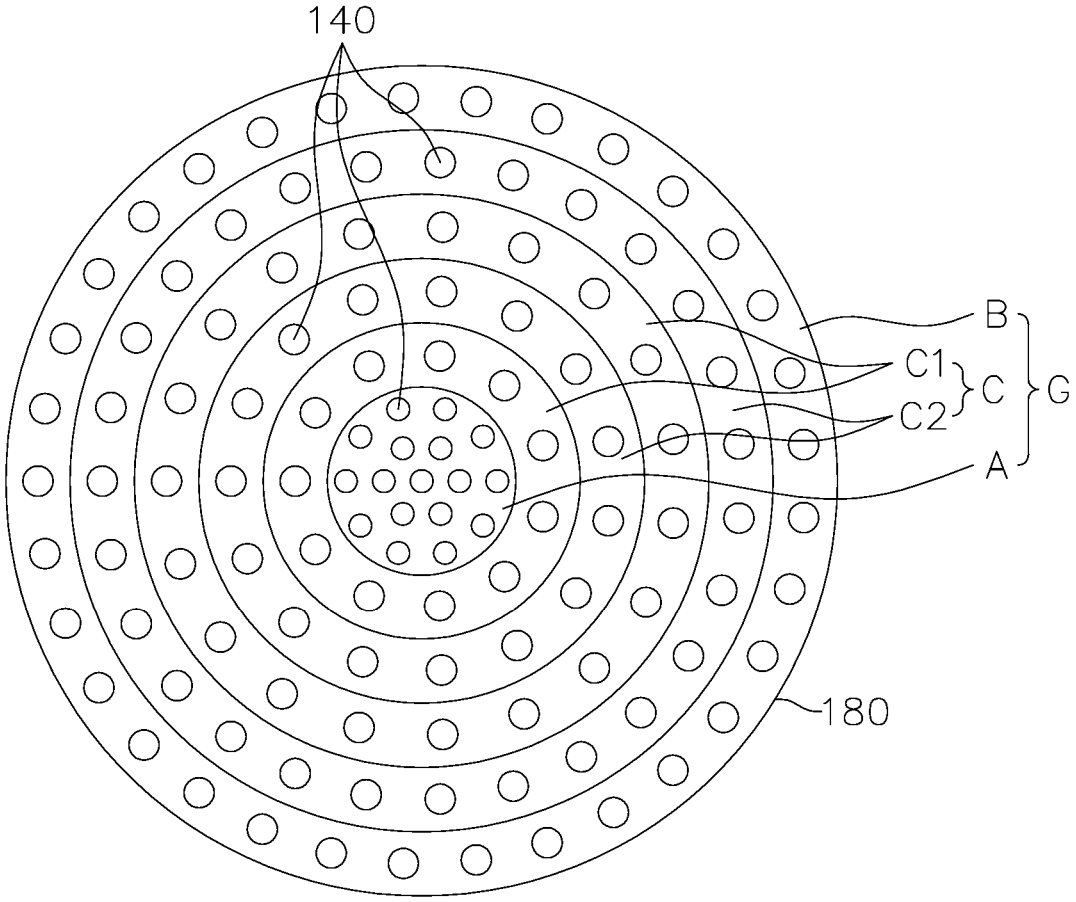
FIG. 4 is a view illustrating an arrangement of a plurality of fuel nozzles disposed in multiple tubes.
Figure 5:
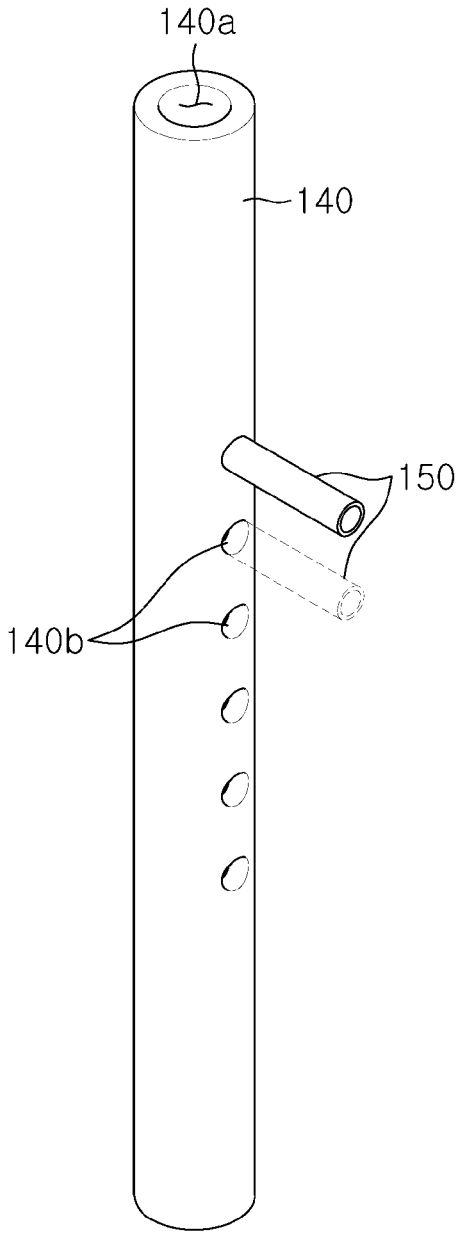
FIG. 5 is an enlarged view illustrating a state in which a compressed air supply tube is connected to a fuel nozzle constituting a second group.

The nozzle base 110*a* is connected to an end cover C, and the end cover C may include a configuration for at least partially receiving the fuel. Hereinafter, a multi-tube combustor according to an exemplary embodiment will be described. FIG. 3 is a cross-sectional view illustrating a construction of a multi-tube combustor according to an exemplary embodiment. FIG. 4 is a view illustrating an arrangement of a plurality of fuel nozzles disposed in multiple tubes. FIG. 5 is an enlarged view illustrating a state in which a compressed air supply tube is connected to a fuel nozzle constituting a second group.

Referring to FIGS. 3 and 5, the nozzle casing 110 may be mounted in the casing of the gas turbine, and a plurality of nozzle bases 110*a* are disposed in the nozzle casing 110 and are connected to a fuel supply unit.

A first end of the center body 160 is connected to the nozzle base 110*a*, and a second end of the center body 160 is provided with a fuel injection hole 160*a* through which fuel is injected. The center body 160 is extended to be disposed in the cavity 140*a* of the fuel nozzle 140 to inject fuel into the fuel nozzle 140. There may be a plurality of center bodies 160.

The nozzle tube 180 is connected to the nozzle casing 110 and may have a cylindrical shape. The nozzle tube 180 may include a plurality of through-holes 180*a* in the circumferential side surface, and a plurality of compressed air supply tubes 150 are inserted into each of the through-holes 180*a* so that the compressed air is supplied to the fuel nozzle 140 from the compressor section 120.

A plurality of fuel nozzles 140 may be disposed in the nozzle tube 180 and each of the fuel nozzles 140 may have a cylindrical body having a cylindrical cavity 140*a*. Fuel and compressed air are mixed in the cavity 140*a* of the fuel nozzle 140. The plurality of fuel nozzles 140 disposed in the nozzle tube 180 are divided into a plurality of groups G.

Referring to FIG. 4, the cross-sectional area of the nozzle tube 180 is divided into a plurality of concentric annular regions. The group of fuel nozzles 140 disposed within a central region of the cross-sectional area is referred to as a first group A, the group of fuel nozzles 140 disposed within an outermost annular region of the cross-sectional area is referred to as a second group B, and the group of fuel nozzles 140 disposed within an annular region between the first group A and the second group B is referred to as a third group C.

The third group C disposed between the first group A and the second group B is divided into a plurality of first sub-third groups C1 and a second sub-third groups C2. The innermost first sub-third group C1 is close to the first group A, and the outermost second sub-third group C2 is close to the second group B. The first sub-third groups C1 and the second sub-third groups are alternately arranged in the radial direction.

Referring to FIGS. 3 and 4, the fuel-air mixture ejected by each fuel nozzle of the first group A, the second group B, the third group C, the first sub-third group C1, and the second sub-third group C2 is different from each other. In addition, each group of fuel nozzles preferably has different nozzle length and diameter.

Because the fuel nozzles have different lengths and diameters for each of the first group A, second group B, third group C, first sub-third group C1, and second sub-third group C2, it is possible to reduce the vibration and noise during combustion by preventing the natural frequencies between the flames generated from the fuel-air mixtures injected from each fuel nozzle in each group to coincide.

Referring to FIG. 3 to FIG. 5, each of the plurality of compressed air supply tubes 150 includes a first tube portion 151, a second tube portion 152, and a third tube portion 153. The first compressed air supply tube 151 is connected to the fuel nozzles 140 of the first group A and supplies the compressed air supplied from the compressor section 20 to the fuel nozzles 140 of the first group A.

The second compressed air supply tube 152 is connected to the fuel nozzles 140 of the second group B and supplies the compressed air supplied from the compressor section 20 to the fuel nozzles 140 of the second group B. The third compressed air supply tube 153 is connected to the fuel nozzles 140 of the third group C and supplies the compressed air supplied from the compressor section 20 to the fuel nozzles 140 of the second group C.

Each of the fuel nozzles 140 of the second group B and the fuel nozzles 140 of the third group C is provided with a through-hole 140*b* through which the first compressed air supply tube 151 and the second compressed air supply tube 152 intersect.

When the operation of the gas turbine is started, it is preferable to burn a mixture of the fuel injected from the fuel nozzles of the first group A and the compressed air, and after the operation of the gas turbine is started, it is preferable to burn a mixture of the fuel injected from the fuel nozzles of the second and third groups B and C and the compressed air to achieve stable combustion.

After the operation of the gas turbine is started, i.e. during the operation of the gas turbine, the fuel nozzles 140 of the first group A, the second group B, and the first sub-third group C1, and the second sub-third group C2 are variously combined to supply the fuel so that the combustion condition of the combustor 100 can be adaptively controlled in accordance with the required NOx emissions, the combustion vibrations, and the like.

That is, the plurality of fuel nozzles 140 disposed in the nozzle tube 180 are divided into a plurality of fuel nozzle groups G, and each fuel nozzle group is arranged in an annular concentric circle in order from the center of the nozzle tube 180, and the fuel nozzles may have different diameters for each fuel nozzle group. Thus, the mixing ratio of the fuel and the compressed air is adjusted according to the selection of the fuel nozzle groups through which the fuel-air mixture is ejected to easily meet the required load conditions or to cope with combustion vibrations. Therefore, it is possible to actively cope with fluctuation in NOx level and combustion vibration to stably generate flames, and to reduce vibrations generated during the ramp-up process after starting the gas turbine.

While exemplary embodiments have been described with reference to the accompanying drawings, it will be apparent to those skilled in the art that various modifications in form and details may be made therein without departing from the spirit and scope as defined in the appended claims. Therefore, the description of the exemplary embodiments should be construed in a descriptive sense and not to limit the scope of the claims, and many alternatives, modifications, and variations will be apparent to those skilled in the art.

What is claimed is:

1. A multi-tube combustor comprising:

a nozzle casing configured to receive a compressed air from a compressor section and to receive a fuel from an outside;

a liner coupled to the nozzle casing and defining a combustion chamber in which a mixture of the fuel and the compressed air is combusted;

a transition piece connected to the liner and configured to supply combustion gas generated in the combustion chamber to a turbine section;

a group of first fuel nozzles, a group of second fuel nozzles, and a group of third fuel nozzles disposed in a nozzle tube provided inside the nozzle casing, each of the first fuel nozzles, second fuel nozzles, and third fuel nozzles having a cavity;

a plurality of compressed air supply tubes, wherein a first compressed air supply tube from the plurality of compressed air supply tubes is connected to a first fuel nozzle from the group of first fuel nozzles to supply a first portion of the compressed air to the first fuel nozzle, a second compressed air supply tube from the plurality of compressed air supply tubes is connected to a second fuel nozzle from the group of second fuel nozzles to supply a second portion of the compressed air to the second fuel nozzle, and a third compressed air supply tube from the plurality of compressed air supply tubes is connected to a third fuel nozzle from the group of third fuel nozzles to supply a third portion of the compressed air to the third fuel nozzle, a plurality of nozzle bases on the nozzle casing; and a plurality of center bodies, each of the plurality of center bodies extending from a first end connected to a respective one of the plurality of nozzle bases, to a second end in a respective one of the cavities of the first fuel nozzles, second fuel nozzles, and third fuel nozzles, the respective second end of each of the plurality of center bodies having a fuel ejection hole through which the fuel is ejected;

wherein the fuel and the compressed air are mixed inside each of the first fuel nozzles and second fuel nozzles, and the mixture of the fuel and the compressed air is ejected from one or more selected groups from the group of first fuel nozzles and the group of second fuel nozzles according to a combustion load condition or during a ramp-up process, wherein a first center body of the plurality of center bodies extends into the cavity of the first fuel nozzle from the group of first fuel nozzles and a second center body of the plurality of center bodies extends into the cavity of the second fuel nozzle from the group of second fuel nozzles;

wherein a first upstream end of the first fuel nozzle from the group of first fuel nozzles is disposed in a first virtual plane to receive the first center body, and a second upstream end of the second fuel nozzle from the group of second fuel nozzles is disposed in a second virtual plane parallel with, and different from the first virtual plane, to receive the second center body;

wherein the first end of the first center body and the first end of the second center body are connected to the respective nozzle bases at a third virtual plane parallel with, and different from, the first virtual plane and the second virtual plane;

wherein a length of the first fuel nozzle from the group of first fuel nozzles is different from a length of the second fuel nozzle from the group of second fuel nozzles and/or a diameter of the first fuel nozzle from the group of first fuel nozzles is different from a diameter of the second fuel nozzle from the group of second fuel nozzles;

wherein the group of first fuel nozzles are disposed at a center of the nozzle tube and arranged to form a first annular line, the group of second fuel nozzles are disposed in a periphery area of the nozzle tube and arranged to form a second annular line, the group of third fuel nozzles are disposed between the group of first fuel nozzles and the group of the second fuel nozzles, and the first annular line is disposed concentrically with the second annular line; and wherein the first compressed air supply tube is connected to the first fuel nozzle from the group of first fuel nozzles by inserting and passing through a first through-hole provided in the second fuel nozzle from the group of second fuel nozzles and a second through-hole provided in the third fuel nozzle from the group of third fuel nozzles, and the third compressed air supply tube is connected to the third fuel nozzle from the group of third fuel nozzles by inserting and passing through a third through-hole provided in the second fuel nozzle from the group of second fuel nozzles.

2. The multi-tube combustor according to claim 1, wherein the group of third fuel nozzles comprises:

a group of first sub-third fuel nozzles arranged to form at least one first intermediate annular line, wherein an innermost first intermediate annular line from the at least one first intermediate annular line is disposed outside of and adjacent to the first annular line formed by the group of first fuel nozzles; and a group of second sub-third fuel nozzles is arranged to form at least one second intermediate annular line, wherein an outermost second intermediate annular line from the at least one second intermediate annular line is disposed inside of and adjacent to the second annular line formed by the group of second fuel nozzles.

3. The multi-tube combustor according to claim 2, wherein a length of the third fuel nozzle from the group of third fuel nozzles is different from the length of the first fuel nozzle from the group of first fuel nozzles and/or a diameter of the third fuel nozzle from the group of third fuel nozzles is different from the diameter of the first fuel nozzle from the group of first fuel nozzles.

4. The multi-tube combustor according to claim 2, wherein a length of a first sub-third fuel nozzle from the group of first sub-third fuel nozzles is different from a length of a second sub-third fuel nozzle from the group of second sub-third fuel nozzles and/or a diameter of the first sub-third fuel nozzle from the group of first sub-third fuel nozzles is different from a diameter of the second sub-third fuel nozzle from the group of second sub-third fuel nozzles.

5. The multi-tube combustor according to claim 2, wherein the at least one first intermediate annular line is multiple first intermediate annular lines concentrically disposed with each other and the at least one second intermediate annular line is multiple second intermediate annular lines concentrically disposed with each other, and the multiple first intermediate annular lines and the multiple second intermediate annular lines are alternatingly arranged.

6. The multi-tube combustor according to claim 1, further comprising: a plurality of on/off valves, each of the plurality of on/off valves provided on a respective one of the plurality of compressed air supply tubes to open and close the respective one of the plurality of compressed air supply tubes; and a controller configured to control operation of each of the plurality of on/off valves to open and close the respective one of the plurality of compressed air supply tubes.

7. A multi-tube combustor comprising:

a nozzle casing configured to receive a compressed air from a compressor section and to receive a fuel from an outside;

a liner coupled to the nozzle casing and defining a combustion chamber in which a mixture of the fuel and the compressed air is combusted;

a transition piece connected to the liner and configured to supply combustion gas generated in the combustion chamber to a turbine section;

a group of first fuel nozzles, a group of second fuel nozzles, and a group of third fuel nozzles disposed in a nozzle tube provided inside the nozzle casing, each of the first fuel nozzles, second fuel nozzles, and third fuel nozzles having a cavity;

a plurality of compressed air supply tubes, wherein a first compressed air supply tube from the plurality of compressed air supply tubes is connected to a first fuel nozzle from the group of first fuel nozzles to supply a first portion of the compressed air to the first fuel nozzle, a second compressed air supply tube from the plurality of compressed air supply tubes is connected to a second fuel nozzle from the group of second fuel nozzles to supply a second portion of the compressed air to the second fuel nozzle, and a third compressed air supply tube from the plurality of compressed air supply tubes is connected to a third fuel nozzle from the group of third fuel nozzles to supply a third portion of the compressed air to the third fuel nozzle, a plurality of nozzle bases on the nozzle casing; and a plurality of center bodies, each of the plurality of center bodies extending from a first end connected to a respective one of the plurality of nozzle bases, to a second end in a respective one of the cavities of the first fuel nozzles, second fuel nozzles, and third fuel nozzles, the respective second end of each of the plurality of center bodies having a fuel ejection hole through which the fuel is ejected;

wherein the fuel and the compressed air are mixed inside each of the first fuel nozzles and second fuel nozzles, and wherein the mixture of the fuel and the compressed air is ejected from one or more selected groups from the group of first fuel nozzles and the group of second fuel nozzles according to a combustion load condition or during a ramp-up process, wherein the group of first fuel nozzles are disposed at a center of the nozzle tube and arranged to form a first annular line, the group of second fuel nozzles are disposed in a periphery area of the nozzle tube and arranged to form a second annular line, the group of third fuel nozzles are disposed between the group of first fuel nozzles and the group of second fuel nozzles, and the first annular line is disposed concentrically with the second annular line, wherein the second fuel nozzle from the group of second fuel nozzles is provided with a first through-hole and a second through-hole and the third fuel nozzle from the group of third fuel nozzles is provided with a third through-hole, wherein the first compressed air supply tube connects to the first fuel nozzle from the group of first fuel nozzles by inserting and passing through the first through-hole provided in the second fuel nozzle from the group of second fuel nozzles and the third through-hole provided in the third fuel nozzle from the group of third fuel nozzles and the third compressed air supply tube connects to the third fuel nozzle from the group of third fuel nozzles by inserting and passing through the second through-hole provided in the second fuel nozzle from the group of second fuel nozzles.

8. A gas turbine comprising:

a casing;

a compressor section disposed inside the casing and configured to compress an air externally introduced to produce a compressed air;

a combustor disposed inside the casing and configured to mix the compressed air compressed by the compressor section with a fuel and combust a mixture of the compressed air and the fuel to produce a combustion gas;

a turbine section disposed inside the casing and rotated by the combustion gas produced by the combustor to generate power; and a diffuser disposed inside the casing and configured to discharge the combustion gas from the turbine section, wherein the combustor comprises:

a nozzle casing configured to receive the compressed air from the compressor section and to receive the fuel from outside;

a liner coupled to the nozzle casing and defining a combustion chamber in which the mixture of the fuel and the compressed air is combusted;

a transition piece connected to the liner and configured to supply the combustion gas generated in the combustion chamber to the turbine section;

a group of first fuel nozzles, a group of second fuel nozzles, and a group of third fuel nozzles disposed in a nozzle tube provided inside the nozzle casing, each of the first fuel nozzles, second fuel nozzles, and third fuel nozzles having a cavity;

a plurality of compressed air supply tubes, wherein a first compressed air supply tube from the plurality of compressed air supply tubes is connected to a first fuel nozzle from the group of first fuel nozzles to supply a first portion the compressed air to the first fuel nozzle, a second compressed air supply tube from the plurality of compressed air supply tubes is connected to a second fuel nozzle from the group of second fuel nozzles to supply a second portion of the compressed air to the second fuel nozzle, and a third compressed air supply tube from the plurality of compressed air supply tubes is connected to a third fuel nozzle from the group of third fuel nozzles to supply a third portion of the compressed air to the third fuel nozzle, a plurality of nozzle bases on the nozzle casing; and a plurality of center bodies, each of the plurality of center bodies extending from a first end connected to a respective one of the plurality of nozzle bases, to a second end in a respective one of the cavities of the first fuel nozzles, second fuel nozzles, and third fuel nozzles, the respective second end of each of the plurality of center bodies having a fuel ejection hole through which the fuel is ejected;

wherein the fuel and the compressed air are mixed inside each of the first fuel nozzles and second fuel nozzles, and the mixture of the fuel and the compressed air is ejected from one or more selected groups from the group of first fuel nozzles and the group of second fuel nozzles according to a combustion load condition or during a ramp-up process, and wherein a first center body of the plurality of center bodies extends into the cavity of the first fuel nozzle from the group of first fuel nozzles and a second center body of the plurality of center bodies extends into the cavity of the second fuel nozzle from the group of second fuel nozzles;

wherein a first upstream end of the first fuel nozzle from the group of first fuel nozzles is disposed in a first virtual plane to receive the first center body, and a second upstream end of the second fuel nozzle from the group of second fuel nozzles is disposed in a second virtual plane parallel with, and different from the first virtual plane, to receive the second center body;

wherein the first end of the first center body and the first end of the second center body are connected to the respective nozzle bases at a third virtual plane parallel with, and different from, the first virtual plane and the second virtual plane;

wherein a length of the first fuel nozzle from the group of first fuel nozzles is different from a length of the second fuel nozzle from the group of second fuel nozzles and/or a diameter of the first fuel nozzle from the group of first fuel nozzles is different from a diameter of the second fuel nozzle from the group of second fuel nozzles;

wherein the group of first fuel nozzles are disposed at a center of the nozzle tube and arranged to form a first annular line, the group of second fuel nozzles are disposed in a periphery area of the nozzle tube and arranged to form a second annular line, the group of third fuel nozzles are disposed between the group of first fuel nozzles and the group of second fuel nozzles, and the first annular line is disposed concentrically with the second annular line; and wherein the first compressed air supply tube is connected to the first fuel nozzle from the group of first fuel nozzles by inserting and passing through a first through-hole provided in the second fuel nozzle from the group of second fuel nozzles and a second through-hole provided in the third fuel nozzle from the group of third fuel nozzles, and the third compressed air supply tube is connected to the third fuel nozzle from the group of third fuel nozzles by inserting and passing through a third through-hole provided in the second fuel nozzle from the group of second fuel nozzles.

9. The gas turbine according to claim 8, wherein the group of third fuel nozzles comprises:

a group of first sub-third fuel nozzles arranged to form at least one first intermediate annular line, wherein an innermost first intermediate annular line from the at least one first intermediate annular line is disposed outside of and adjacent to the first annular line formed by the group of first fuel nozzles; and a group of second sub-third fuel nozzles is arranged to form at least one second intermediate annular line, wherein an outermost second intermediate annular line from the at least one second intermediate annular line is disposed inside of and adjacent to the second annular line formed by the group of second fuel nozzles.

10. The gas turbine according to claim 9, wherein a length of the third fuel nozzle from the group of third fuel nozzles is different from the length of the first fuel nozzle from the group of first fuel nozzles and/or a diameter of the third fuel nozzle from the group of third fuel nozzles is different from the diameter of the first fuel nozzle from the group of first fuel nozzles.

11. The gas turbine according to claim 9, wherein a length of a first sub-third fuel nozzle from the group of first sub-third fuel nozzles is different from a length of a second sub-third fuel nozzle from the group of second sub-third fuel nozzles and/or a diameter of the first sub-third fuel nozzle from the group of first sub-third fuel nozzles is different from a diameter of the second sub-third fuel nozzle from the group of second sub-third fuel nozzles.

12. The gas turbine according to claim 9, wherein the at least one first intermediate annular line is multiple first intermediate annular lines concentrically disposed with each other and the at least one second intermediate annular line is multiple second intermediate annular lines concentrically disposed with each other, and the multiple first intermediate annular lines and the multiple second intermediate annular lines are alternatingly arranged.

13. The gas turbine according to claim 8, further comprising:

a plurality of on/off valves, each of the plurality of on/off valves provided on a respective one of the plurality of compressed air supply tubes to open and close the respective one of the plurality of compressed air supply tubes; and a controller configured to control operation of each of the plurality of on/off valves to open and close the respective one of the plurality of compressed air supply tubes.

* * * * *